US009638004B2

(12) United States Patent
Castro

(10) Patent No.: US 9,638,004 B2
(45) Date of Patent: May 2, 2017

(54) RESETTABLE BALL SEAT FOR HYDRAULICALLY ACTUATING TOOLS

(71) Applicant: Weatherford/Lamb, Inc., Houston, TX (US)

(72) Inventor: Candido Castro, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 414 days.

(21) Appl. No.: 14/180,618

(22) Filed: Feb. 14, 2014

(65) Prior Publication Data

US 2014/0262325 A1 Sep. 18, 2014

Related U.S. Application Data

(60) Provisional application No. 61/778,041, filed on Mar. 12, 2013.

(51) Int. Cl.
*E21B 34/14* (2006.01)
*E21B 34/00* (2006.01)

(52) U.S. Cl.
CPC ..... *E21B 34/14* (2013.01); *E21B 2034/002* (2013.01)

(58) Field of Classification Search
CPC ..... E21B 34/14; E21B 2034/002; E21B 2034/005
See application file for complete search history.

(56) References Cited

U.S. PATENT DOCUMENTS

| | | | | |
|---|---|---|---|---|
| 3,398,928 | A | 8/1968 | Fredd | |
| 4,220,176 | A * | 9/1980 | Russell | E21B 21/10 137/496 |
| 4,871,019 | A | 10/1989 | Haley et al. | |
| 5,553,672 | A | 9/1996 | Smith, Jr. et al. | |
| 6,866,100 | B2 | 3/2005 | Gudmestad et al. | |
| 6,920,930 | B2 | 7/2005 | Allamon et al. | |
| 8,672,035 | B2 * | 3/2014 | Telfer | E21B 23/006 166/318 |
| 2004/0035586 | A1 | 2/2004 | Gudmestad et al. | |
| 2007/0272420 | A1 | 11/2007 | Reimert et al. | |

(Continued)

OTHER PUBLICATIONS

Patent Examination Report No. 1 for corresponding AU Patent Application No. 2014249159; dated Feb. 8, 2016; pp. 1-2.

(Continued)

*Primary Examiner* — Robert E Fuller
*Assistant Examiner* — Steven MacDonald
(74) *Attorney, Agent, or Firm* — Blank Rome LLP

(57) ABSTRACT

A downhole tool has a housing, mandrel, and ball seat. The housing defines a first bore, and the mandrel defines a second bore. The mandrel is disposed in the first bore of the housing and defines an annular space with the housing. The ball seat is rotatably disposed in the second bore of the mandrel and defines an interior passage with a seat profile. First and second pistons are disposed in the annular space on opposing sides of the ball seat. These first and second pistons are movable along an axis of the tool in the annular space in opposing directions and are adapted to rotate the ball seat. Additionally, first and second biasing members are disposed in the annular space and bias the first and second pistons toward one another to reset the ball seat in the absence of pressure.

40 Claims, 15 Drawing Sheets

(56) References Cited

U.S. PATENT DOCUMENTS

| | | | | |
|---|---|---|---|---|
| 2008/0223581 | A1 | 9/2008 | Beall et al. | |
| 2010/0084146 | A1 | 4/2010 | Roberts | |
| 2011/0088906 | A1 | 4/2011 | Myerley | |
| 2011/0174505 | A1 | 7/2011 | Gill et al. | |
| 2011/0192607 | A1 | 8/2011 | Hofman et al. | |
| 2011/0226491 | A1* | 9/2011 | Telfer | E21B 23/006 166/384 |
| 2013/0248201 | A1 | 9/2013 | Jackson | |

OTHER PUBLICATIONS

Int'l Search Report and Written Opinion in counterpart PCT appl. PCT/US2014/023116, mailed Dec. 22, 2014.

* cited by examiner

RESETTABLE BALL SEAT FOR HYDRAULICALLY ACTUATING TOOLS

CROSS-REFERENCE TO RELATED APPLICATIONS

This application claims the benefit of U.S. Provisional Appl. 61/778,041, filed 12 Mar. 2013, which is incorporated herein by reference.

BACKGROUND OF THE DISCLOSURE

In the completion of oil and gas wells, downhole tools are mounted on the end of a workstring, such as a drill string, a landing string, a completion string, or a production string. The workstring can be any type of wellbore tubular, such as casing, liner, tubing, and the like. A common operation performed downhole temporarily obstructs the flow path within the wellbore to allow the internal pressure within a section of the workstring to be increased. In turn, the increased pressure operates hydraulically actuated tools. For example, a liner hanger can be hydraulically operated to hang a liner in the well's casing.

Sealably landing a ball on a ball seat provides a common way to temporarily block the flow path through a wellbore tubular so a hydraulic tool above the seat can be operated by an increase in pressure. Historically, segmented dogs or keys have been used create a ball seat for landing a ball. Alternatively, a hydro-trip mechanism can use collet fingers that deflect and create a ball seat for engaging a dropped ball. Segmented ball seats may be prone to fluid leakage and tend to require high pump rates to shear open the ball seat. Additionally, the segmented ball seat does not typically open to the full inner diameter of the downhole tubular so the ball seat may eventually need to be milled out with a milling operation.

Any of the hydraulic tools that are to be actuated and are located above the ball seat need to operate at a pressure below whatever pressure is needed to eventually open or release the ball seat. Internal pressures can become quite high when breaking circulation or circulating a liner through a tight section. To avoid premature operation of the tool at these times, the pressure required to open or to release a ball seat needs to be high enough to allow for a sufficiently high activation pressure for the tool. For example, ball seats can be assembled to open or release at a predetermined pressure that can exceed 3000 psi.

Once the hydraulically-actuated tool, such as a liner hanger or packer are actuated, operators want to remove the obstruction in the tubular's flow path. Since the ball seat is a restriction in the wellbore, it must be opened up, moved out of the way, or located low enough in the well to not interfere with subsequent operations. For example, operators will want to move the ball and seat out of the way. Various ways can be used to reopen the tubular to fluid flow.

Commonly, the ball seat is moved out of the way by having it drop down hole. For example, with the ball landed on the seat, the increasing pressure above the ball seat can eventually cause a shearable member holding the ball seat to shear, releasing the ball seat to move downhole with the ball. However, this leaves the ball and ball seat in the wellbore, potentially causing problems for subsequent operations. Additionally, this may require the removal of both the ball and ball seat at a later time.

In another way to reopen fluid flow through the tubular, increased pressure above the ball seat can eventually force the ball to deformably open the seat, which then allows the ball to pass through. In these designs, the outer diameter of the ball represents a maximum size of the opening that can be created through the ball seat. This potentially limits the size of subsequent equipment that can pass freely through the ball seat and further downhole without the risk of damage or obstruction.

Ball seats may also be milled out of the tubular to reopen the flow path. For example, ball seats made of soft metals, such as aluminum or cast iron, are easier to mill out; however, they may not properly seat the ball due to erosion caused by high volumes of drilling mud being pumped through the reduced diameter of the ball seat. Interference from the first ball seat being released downhole may also prevent the ball from sealably landing on another ball seat below.

One type of ball seat used in the art uses a collet-style mechanism that opens up in a radial direction when shifted past a larger diameter grove. However, these collet-style ball seats are more prone to leaking than solid ball seats, and the open collet fingers exposed inside the tubular create the potential for damaging equipment used in subsequent wellbore operations.

The subject matter of the present disclosure is directed to overcoming, or at least reducing the effects of, one or more of the problems set forth above.

DETAILED DESCRIPTION OF THE DISCLOSURE

Figure 1:
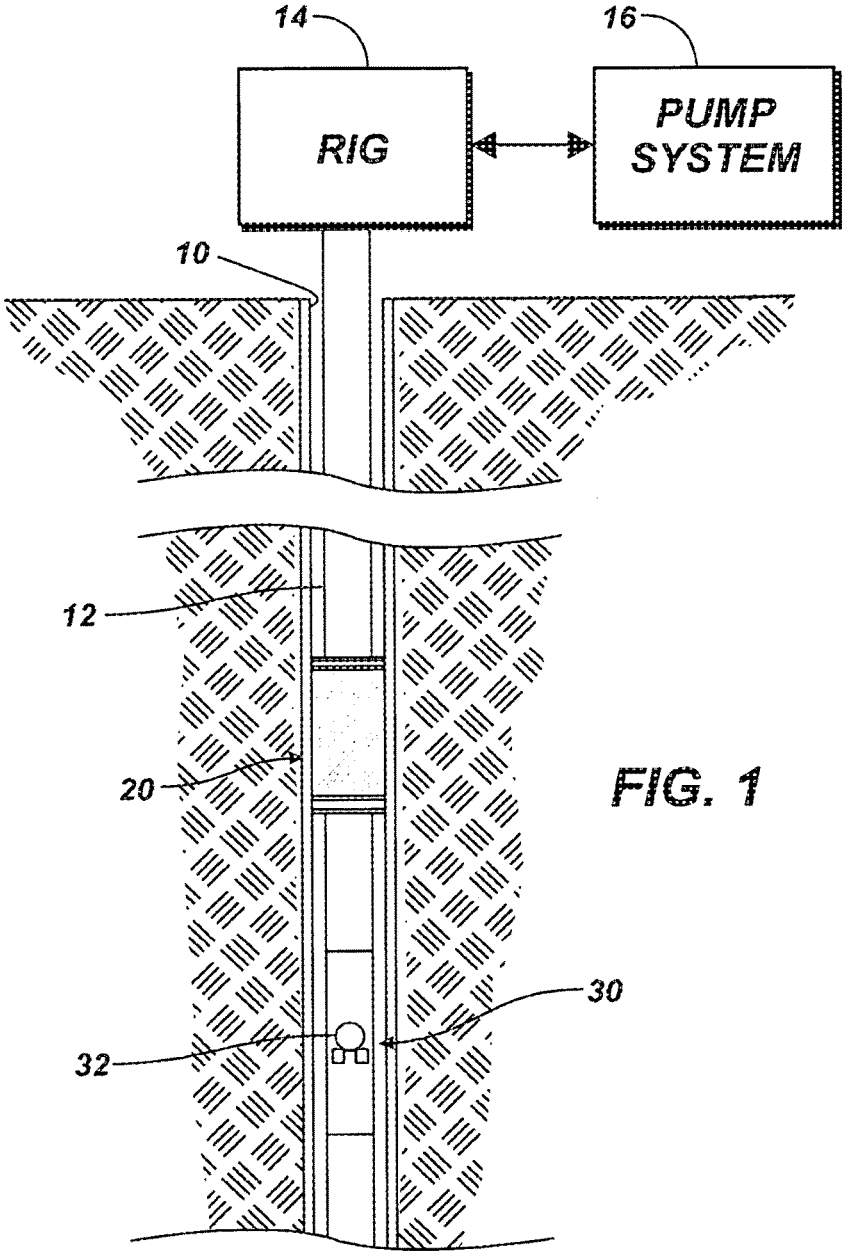
FIG. 1 illustrates a wellbore assembly having a resettable ball seat for actuating a hydraulically actuated tool.

FIG. 1 illustrates a wellbore tubular disposed in a wellbore. A hydraulically-actuated tool 20, such as a packer, a liner hanger, or the like is disposed along the wellbore tubular 12 uphole from a downhole tool 30 having a resettable ball seat 32. The disclosed downhole tool 30 can be used to set the hydraulically-actuated tool 20 and has a rotating resettable ball seat 32 that allows setting balls to pass therethrough.

When operators wish to actuate the hydraulically-actuated tool 20, for instance, an appropriately sized ball is dropped from the rig 14 to engage in the resettable ball seat 32 of the downhole tool 30. With the ball engaged in the seat 32, operators use the pumping system 16 to increase the pressure in the wellbore tubular 12 uphole from the tool 30. In turn, the increased tubing pressure actuates an appropriate mechanism in the hydraulically-actuated tool 20 uphole of the resettable ball seat 32. For example, the tool 20 may be a hydraulically-set packer that has a piston that compresses a packing element in response to the increased tubing pressure.

Once the tool 20 is actuated, operators will want to reopen fluid communication downhole by moving the seated ball out of the way. Rather than milling out the ball and seat or shearing the ball and seat out of the way with increased pressure, the resettable ball seat 32 of the present disclosure allows operators to drop the ball further downhole while resetting the seat 32 to engage another dropped ball, if desired.

Figure 2:
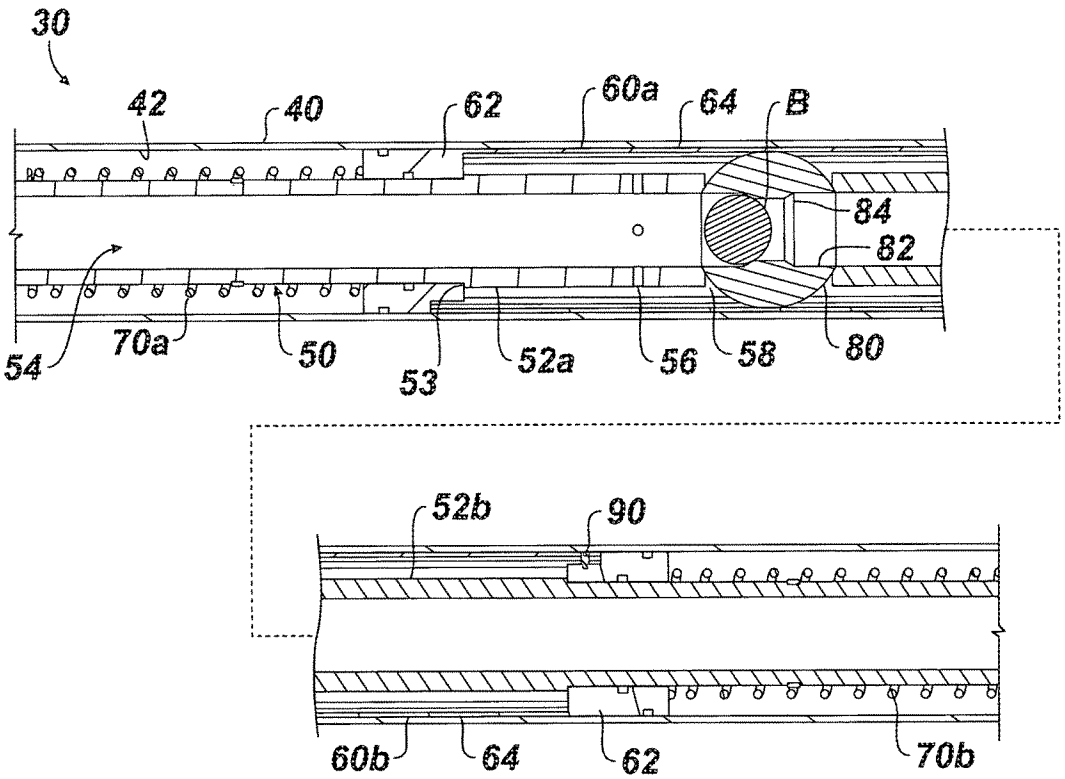
FIG. 2 illustrates a cross-sectional view of a downhole tool having a resettable ball seat according to the present disclosure in a run-in condition.

Turning now to more details of the downhole tool having the resettable ball seat, FIG. 2 illustrates a cross-sectional view of the downhole tool 30 in a run-in condition. The tool 30 includes an outer housing 40, which couples to sections of wellbore tubular (not shown) in a conventional manner, by threads, couplings, or the like. Inside the housing 40, the tool 30 has an internal mandrel 50 fixed in the housing 40. The internal mandrel 50 defines an internal bore 54, which completes the fluid path of the wellbore tubular.

The inner mandrel 50 includes an upper mandrel section 52*a* and a lower mandrel section 52*b* with a rotatable ball seat 80 disposed therebetween. In particular, the rotatable ball seat 80 fits in a space between the distal ends of the two mandrel sections 52*a-b*. If necessary, sealing members (not shown), such as sealing rings or the like, can be used between the sections' ends and the outer surface of the ball seat 80 to maintain fluid isolation therebetween. Disposed in the annular spaces 58 between the upper and lower mandrel sections 52*a-b* on either side of the rotatable ball seat 80, the tool 30 has an uphole piston 60*a* and a downhole piston 60*b*, respectively. A piston head 62 on each of the pistons 60*a-b* engages against an opposing biasing member or spring 70*a-b*—the other end of which engages inside the tool 30 (e.g., against an internal shoulder (not shown) in the space 58.

Figure 6A:
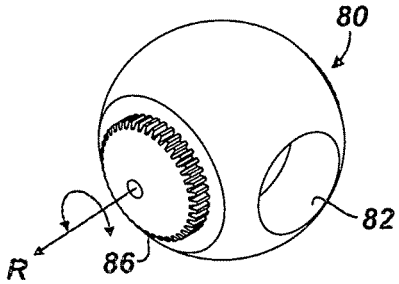
FIG. 6A illustrates the disclosed ball seat in a perspective view.
Figure 6B:
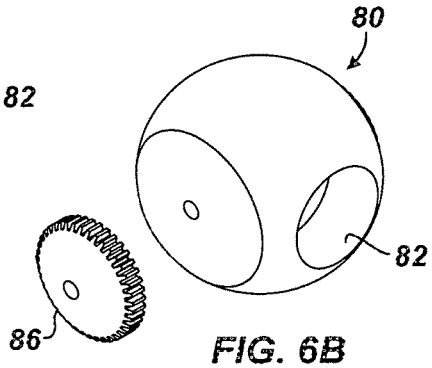
FIG. 6B illustrates the disclosed ball seat as multiple components.

The rotatable ball seat 80 defines a passage 82 therethrough with an internal shoulder 84 symmetrically arranged therein. External features of the rotatable ball seat 80 are shown FIG. 6A-6B. The ball seat 80 is a spherical body with the passage 82 defined through it. On either side of the spherical body, the ball seat 80 has gears 86 arranged to rotate the ball seat 80 about a rotational axis R, which may or may not use pivot pins (not shown) or the like to support the ball seat 80 in the outer housing 40. The ball seat 80 can be integrally formed with the gears 86 as shown in FIG. 6A. Alternatively, as shown in FIG. 6B, the gears 86 may be separate components affixed to the sides of the ball seat 80. For example, fasteners (not shown), such as for pivot pins or the like, can attach the gears 86 to the sides of the ball seat 80.

Figure 8A:
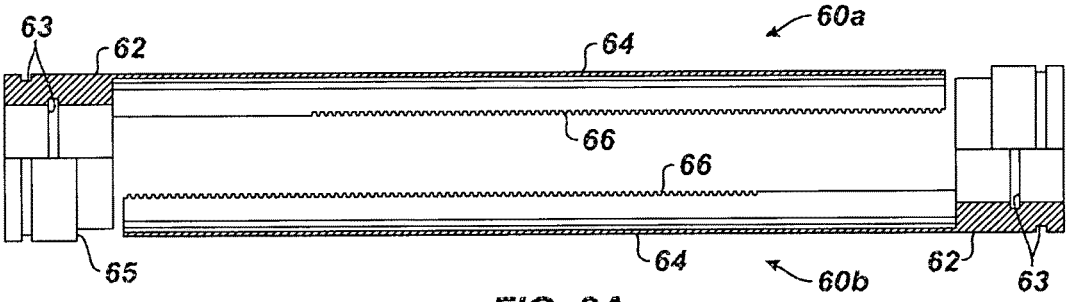
FIG. 8A illustrates a geared sleeve of the downhole tool in partial cross-section.
Figure 8B:
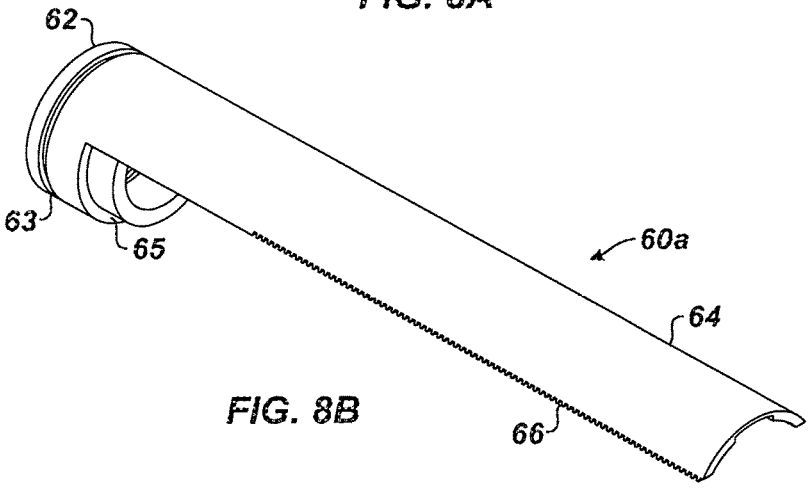
FIG. 8B illustrates the geared sleeve of the downhole tool in a perspective view.

Details of the pistons 60*a-b* are provided in FIGS. 8A-8B. Each of the uphole and downhole pistons 60*a-b* is identical to the other but are arranged to oppose one another inside the downhole tool (30). Each piston 60*a-b* has a piston head 62 disposed at one end. A half cylindrical stem 64 distends from the head 62 and has rack gears 66 defined along its longitudinal edges. Although the head 62 and stem 64 are shown as one piece, they can be manufactured as separate components if desired and can be affixed together in a conventional manner. The head 62 defines circumferential grooves 63 on inside and outside surface for seals, such as O-ring seals. The head 62 also defines a pocket 65 or ledge to accommodate the distal end of the other piston's stem 64 when positioned together.

As shown in FIG. 2, the piston 60*a-b* are disposed in the annular spaces 58 between the housing 40 and mandrel sections 50*a-b* with their heads 62 disposed away from one another. Biased by the springs 70*a-b*, the heads 62 of the pistons 60*a-b*rest against inner stops or shoulders 53 on the mandrel 50. The seals on the heads 62 engage inside of the housing 40 and outside of the mandrel 50 in the annular spaces 58 of the tool 30. The half cylindrical stems 64, however, pass on either side of the rotating ball seat 80, and the gears (66) defined along the edges of the stems 64 engage the gears (86) on the sides of the ball seat 80. As can be surmised from this arrangement, movement of the pistons 60*a-b* in one direction away from each other rotates the ball seat 80 in one direction around its axis (R), while movement of the pistons 60*a-b* toward each other rotates the ball seat 80 in an opposite direction around its axis (R).

Finally, the uphole mandrel section 52*a* defines one or more cross-ports 56 that communicate the tool's internal bore 54 with the annular spaces 58 between the mandrel 50 and the housing 40. Fluid communicated through these cross-ports 56 enters the annular spaces 58 and can act on the inside surfaces of the piston heads 52 against the bias of the opposing springs 70*a-b*.

The tool 30 is shown set in a run-in position in FIG. 2. A ball B has been dropped to land on the ball seat profile 84 inside the ball seat's passage 82. With the ball B seated, operators can pressure up the wellbore tubing uphole of the seat 80 to the required pressure to actuate any hydraulically actuated tools (20: FIG. 1). Once such tools (20) are set, a continued increase in pressure can then be used to reset the ball seat 80. The increased pressure uphole of the seated ball B passes through the cross-ports 56 into the annular space 58 between the piston 50*a-b*. The increased pressure acts against the two opposing piston heads 62 and moves them away from each other in opposite directions.

For example, the increased pressure acting against the two opposing piston heads 62 can eventually shear them free to moves away from each other in opposite directions. Conventional shear pins or other temporary connections can be used to initially hold the pistons 60*a-b* in their run-in position and can subsequently break once the required pressure level is reached. Several options are available for holding the two pistons 60*a-b* together. As shown in FIG. 2, for example, one or more shear pins 90 or other temporary connection can affix the two pistons 60*a-b* together. Here, a shear pin 90 affixes the distal end of one piston's stem 64 to the head 62 of the other piston 60*b*. The opposing stem 64 and head 62 connection between the pistons 60*a-b* can have one or more similar shear pins.

In other options, one or both of the pistons 60*a-b* can be connected by a shear pin or other temporary connection to the mandrel 50, the housing 40, or both. For example, one piston 60*a* can be held by one or more shear pins (not shown) to the upper mandrel section 52, the housing 40, or both. Unable to move as long as the pressure stays below the pressure required to break the temporary connection, the piston 60*a* will not move axially in the space 58, and the ball seat 80 will not rotate. The other piston 60*b* whether it is connected to the mandrel section 52*b* or housing 40 with a shear pin or not will also not be able to move because its gears (66) are enmeshed with the other piston 60*a* and the ball seat's gears (86).

Figure 3:
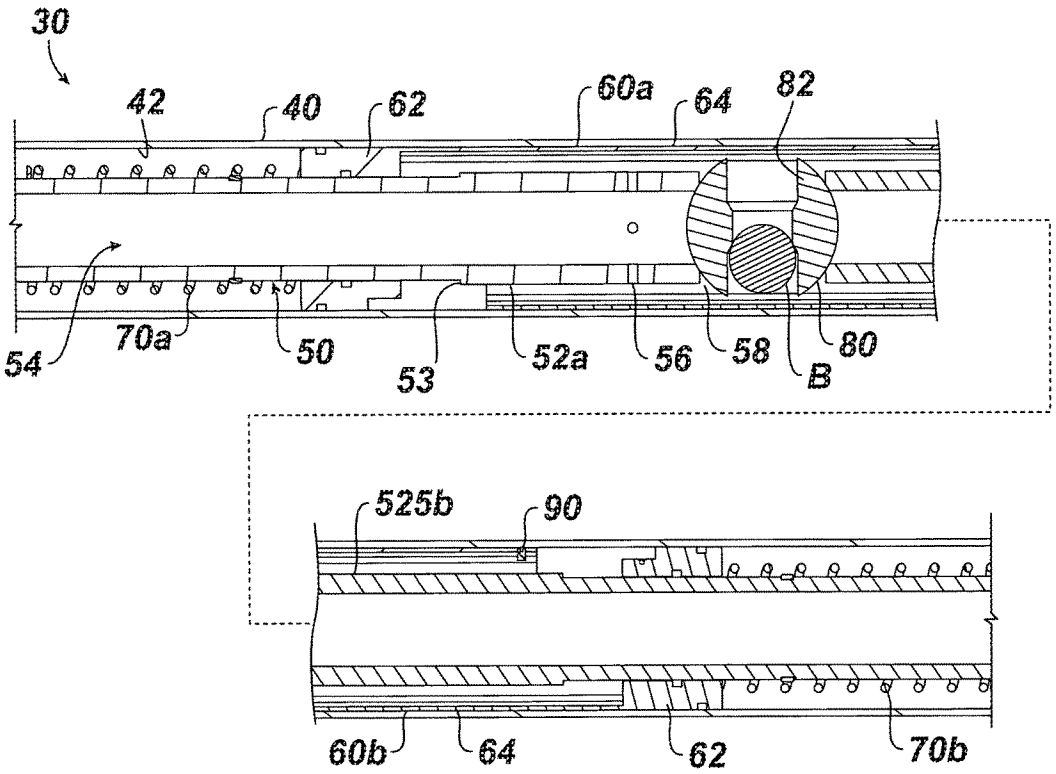
FIG. 3 illustrates a cross-sectional view of the downhole tool having the resettable ball seat in an intermediate condition.

The linear movement of the pistons 60*a-b* is transmitted to the revolving ball seat 80 as the interacting gears (66/86) rotate the ball seat 80. For example, FIG. 3 shows a cross-sectional view of the downhole tool 30 during an intermediate condition. The two pistons 60*a-b* have travelled apart from one another to an extent where the ball seat 80 has rotated 90-degrees. Because pressure pushes the ball against the seat profile 84 and the ball B is sized to fit inside the seat's outer diameter, the ball B rotates with the seat 80 without wedging against the mandrel 50 or housing 40.

Figure 4:
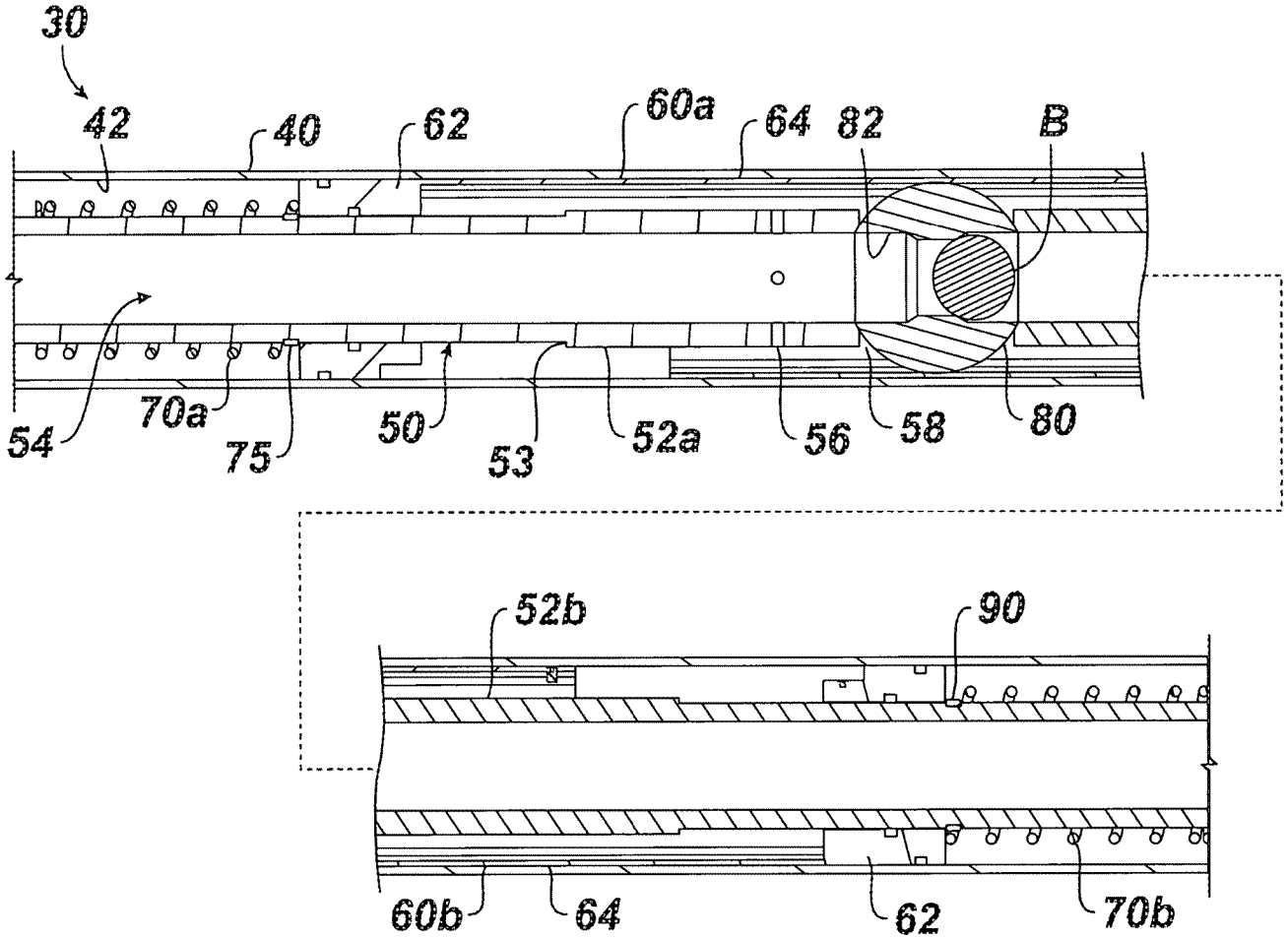
FIG. 4 illustrates a cross-sectional view of the downhole tool having the resettable ball seat in a shifted condition.

Eventually, the pistons 60*a-b* travel a maximum linear distance in the annular space 58, and the ball seat 80 rotates a complete 180-degree turn from its original position. For example, FIG. 4 shows a cross-sectional view of the downhole tool 30 during this shifted condition. Notably, the rotatable ball seat 80 does not need to translate (i.e., move linearly) in the housing 40 to pass the ball B to the other side of the ball seat 80 as other ball releasing mechanisms typically require.

Figure 7:
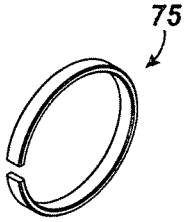
FIG. 7 illustrates a c-ring stop for the disclosed tool.

Stops 75, which can be snap rings, shoulders, or other features disposed on the mandrel 50, for example, can be used to limit the full movement of the pistons 60*a-b*. For example, FIG. 7 shows a stop 75 for the disclosed pistons 60*a-b* in the form of a c-ring that can fit in an external groove on the mandrel sections 50*a-b*.

Figure 5:
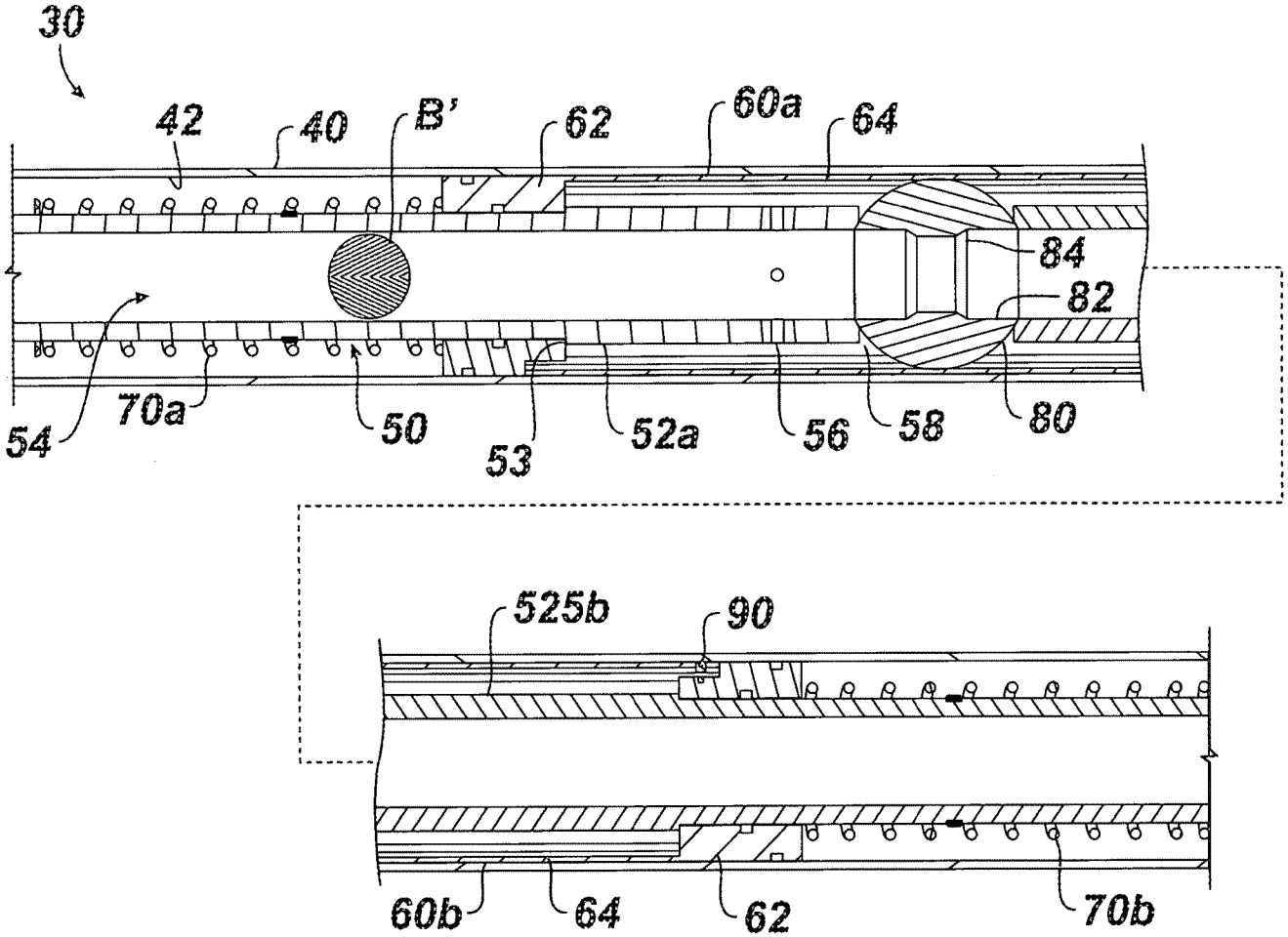
FIG. 5 illustrates a cross-sectional view of the downhole tool having the resettable ball seat in a reset condition.

With the ball seat 80 fully rotated about, the ball B has rotated with the ball seat 80 until it is on the other side of the tool 30. Facing downhole now, the ball B is free to be pumped downhole. Because fluid flow through the tool's bore is no longer obstructed by the ball, pressure buildup in the annular space 58 diminishes, and the springs 70*a-b* force the two pistons 60*a-b* back to the run-position, as shown in FIG. 5. This resets the ball seat 80. Another ball B' can then be dropped into the tool 30 so it can go through the same sequence to pass further downhole. Any temporarily connection between the two pistons 60*a-b* from shear pins or the like is now broken, unless a reconnectable shear or breakable connection is used. At this stage, operators can then drop as many balls B' as desired and the ball seat 80 will reset itself.

Previous embodiments have discussed using the resettable ball seat 80 in a downhole tool 30 that is separate from any hydraulically-actuated tool 20 disposed on a wellbore tubular 12. In other embodiments, the resettable ball seat 80 can actually be incorporated into a hydraulically-actuated tool, such as a packer, a liner hanger, or the like. In fact, the resettable ball seat 80 can actually be used directly as a part of the hydraulic actuating mechanism of such a tool.

Figure 9A:
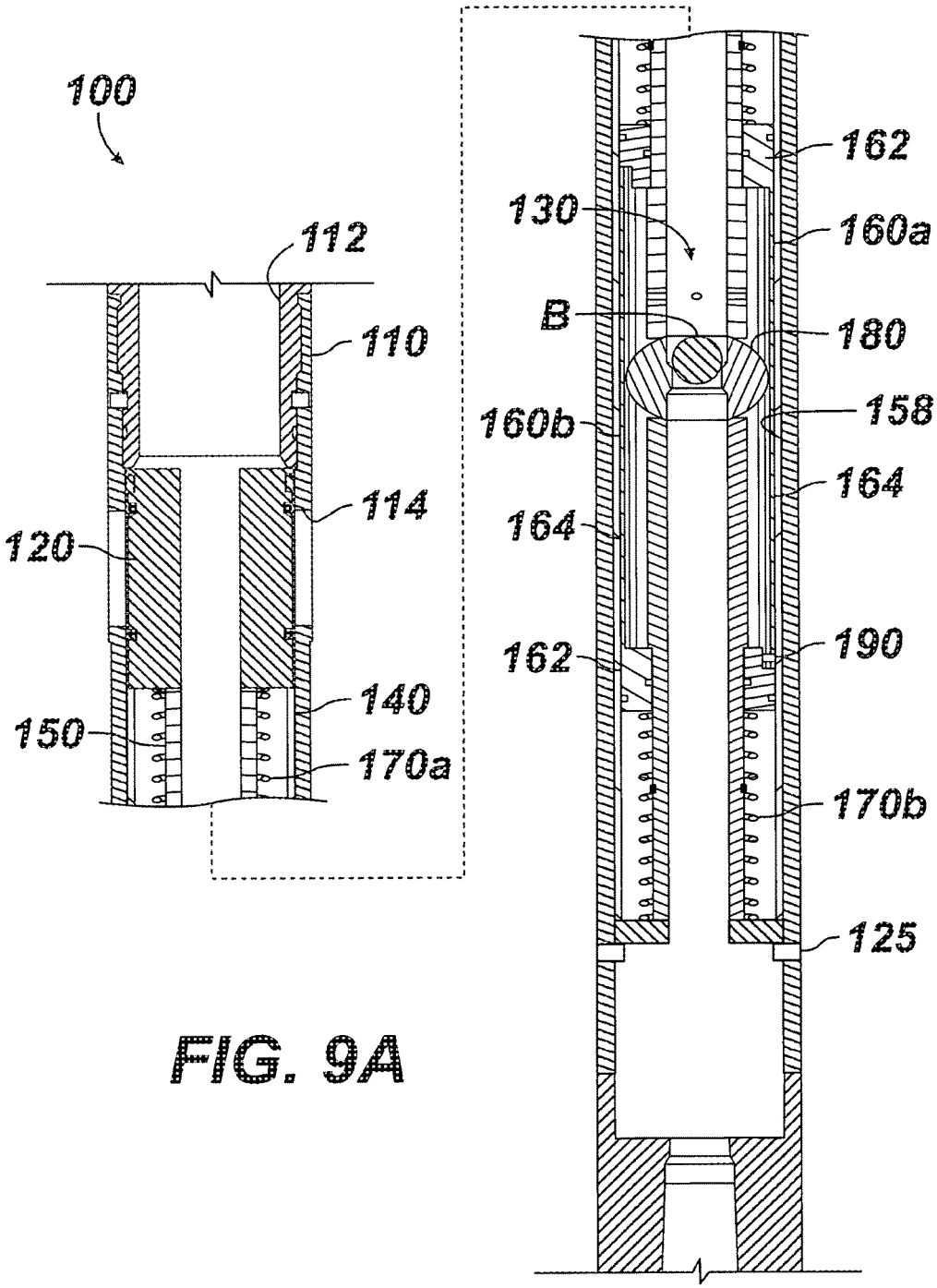
FIGS. 9A-9B illustrate cross-sectional views of a sliding sleeve in closed and opened conditions having a resettable ball seat according to the present disclosure.
Figure 9B:
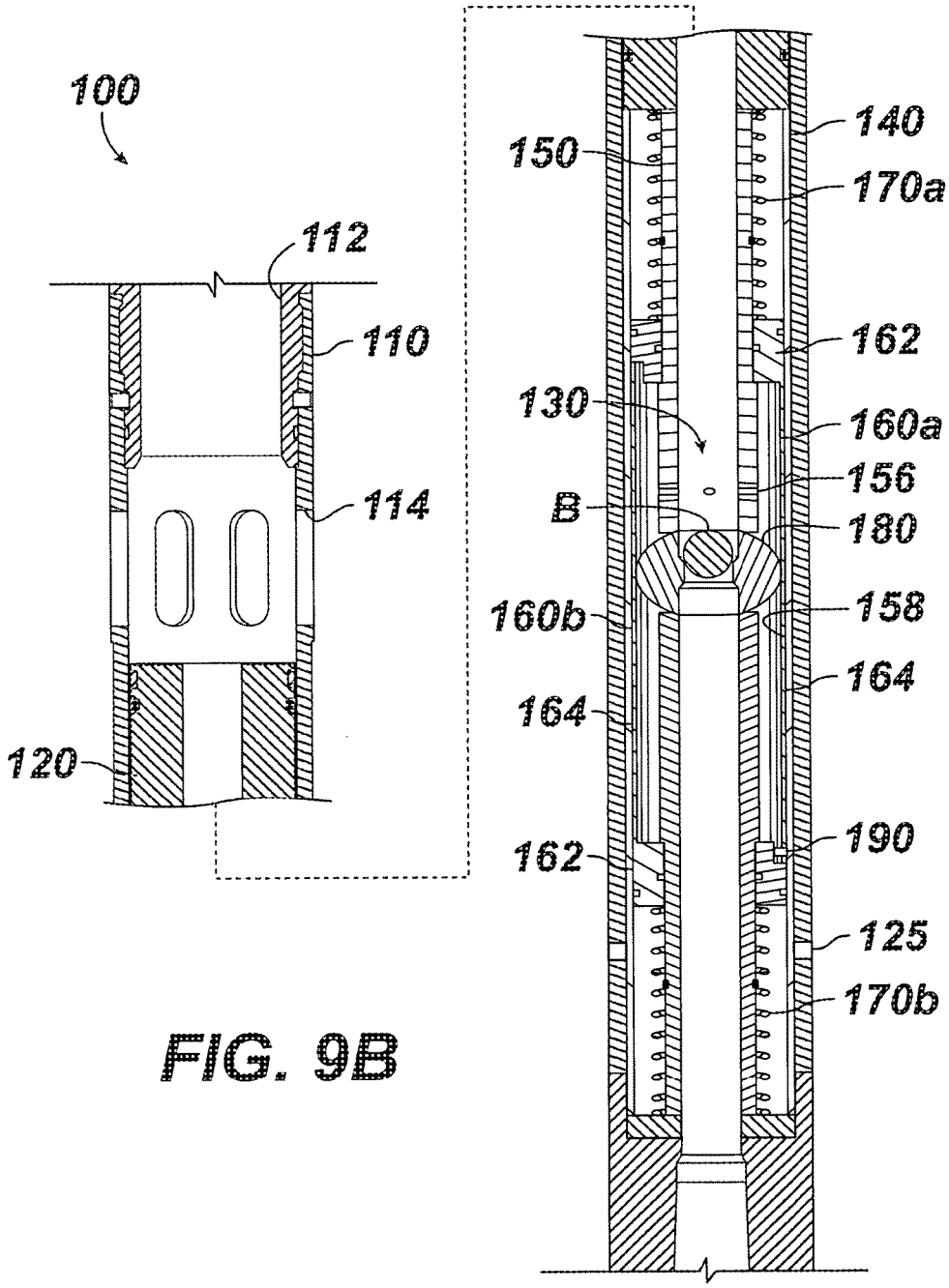

As one particular example, a sliding sleeve can incorporate the resettable ball seat as part of its mechanism for hydraulically opening the sliding sleeve for fracture treatments or other operations. FIGS. 9A-9B show a sliding sleeve 100 in closed and opened states. The sliding sleeve 100 has a tool housing 110 defining one or more ports 114 communicating the housing's bore 112 outside the sleeve 100. An inner sleeve 120 disposed in the tool's bore 112 covers the ports 114 when the inner sleeve 120 is in a closed condition, as shown in FIG. 9A.

A dropped ball B engages in a resettable ball seat 130 that is incorporated into the inner sleeve 120. Pressure applied against the seated ball B eventually shears a set of first shear pins 125 or other breakable connections that hold the inner sleeve 120 in the housing's bore 112. Now free to move, the inner sleeve 120 moves with the applied pressure in the bore 112 and exposes the housings ports 114, as shown in FIG. 9B. Fluid treatment can then be performed to the annulus surrounding the sliding sleeve 100.

When it is then desired to open the resettable ball seat 130, additional pressure applied against the seated ball B, such as during a fracture treatment, can eventually act through the cross-ports 156 in the seat's mandrel 150 and into the annular space 158 where the pressure can act against the pistons 160*a-b*. Eventually, when a predetermined pressure level is reached, one or more shear pins 190 or other breakable connections can break so that the applied pressure moves the pistons 160*a-b* apart and rotates the ball seat 180.

As before, the ball seat 180 can be rotated to the point where the ball B rotates to the other side of the tool 100 and can pass downhole. As before, the springs 170*a-b* can then cause the seat 180 to rotate back and reset once fluid pressure diminishes. Any other ball dropped to the seat 180 can then be passed out the sliding sleeve 100 by rotating the seat 180 with applied pressure.

In the above discussion, the shear pins 125 holding the sleeve 120 have a lower pressure setting than the shear pins 190 holding the seat's pistons 160*a-b*. This allows the sleeve 120 to open with pressure applied against the seat 180 while the seat's pistons 160*a-b* remain in their initial state. Eventual pressure can then break the shear pins 190 for the seat 180 so it can pass the ball B.

Figure 10A:
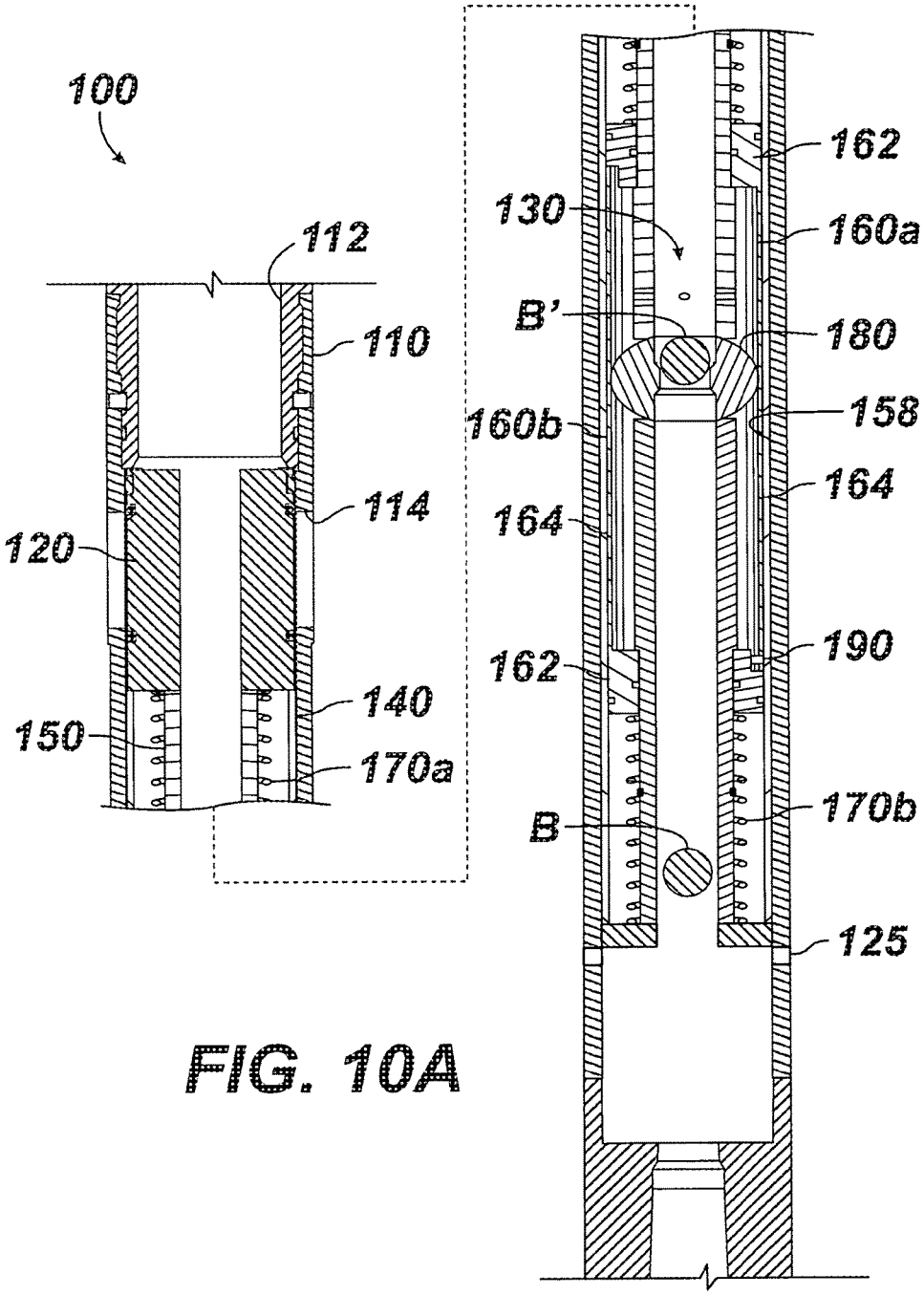
FIGS. 10A-10B illustrate cross-sectional views of the sliding sleeve in additional conditions.

A reverse arrangement of the activation can also be used. As shown in FIG. 10A, a ball B can be dropped to the seat 180 and applied pressure can shear the pistons 160*a-b* free so that the seat 180 rotates and passes the ball B. For example, shear pins 190 used to hold the pistons 160*a-b* may break as pressure entering the annular space 158 from cross-ports 156 builds to a sufficient level to break the shear pin's connection. This can be done while more robust shear pins 125 still hold the inner sleeve 120 and can keep the sleeve 120 closed. Once the ball seat 180 resets, then any number of same sized balls B' can be dropped down to the ball seat 180 and passed through it as before.

Figure 10B:
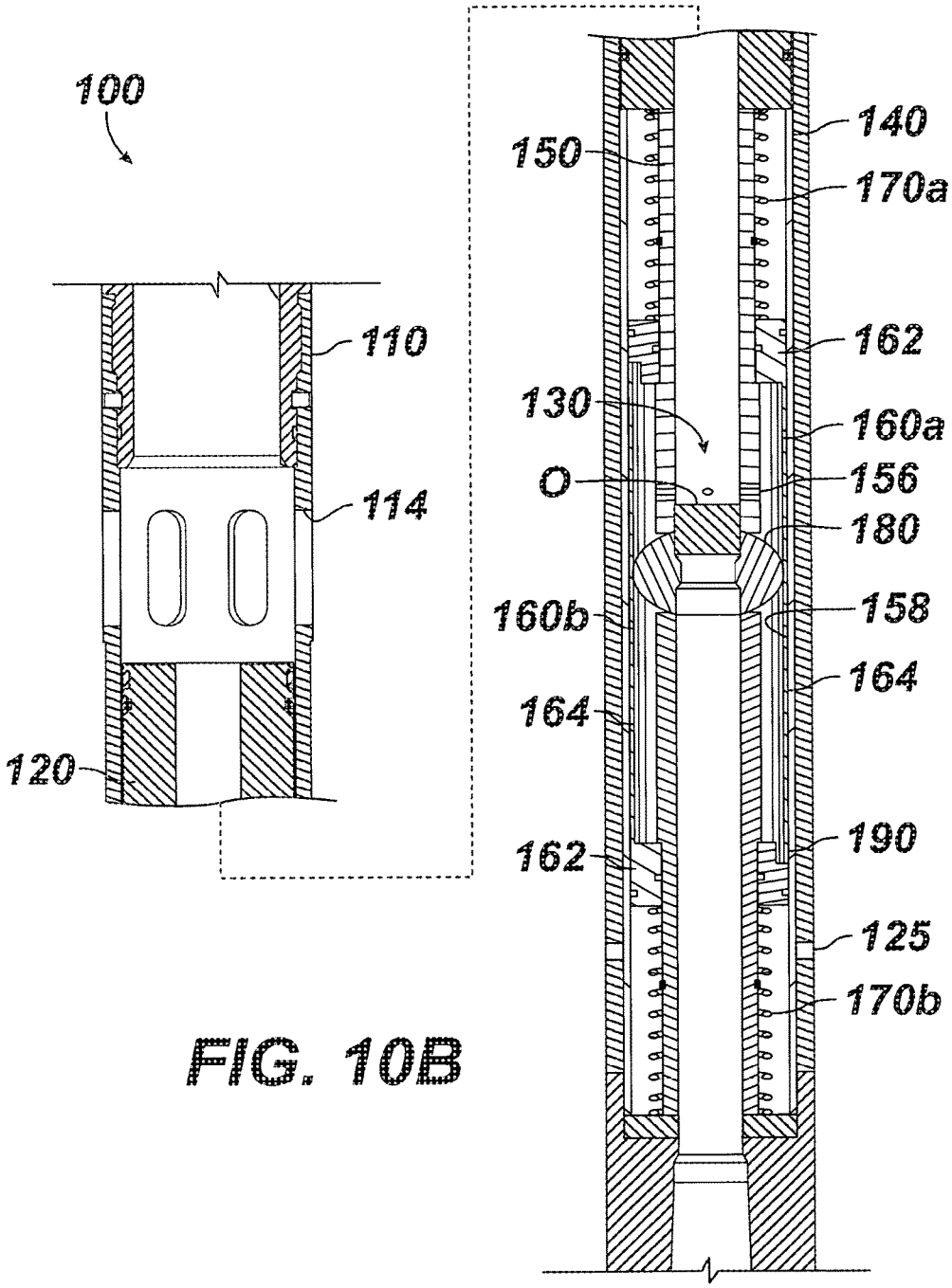

Eventually, when it is desired to open the sleeve 120, a larger ball, dart, plug, or elongated object O (as shown in FIG. 10B) can be deployed downhole to the reset ball seat 180. Engaging the internal profile 184, the larger object O will not allow the ball seat 180 to rotate due to its increased size wedging against the seat 180 and mandrel 150. Consequently, increased pressure can be applied to the seated object O and act against the inner sleeve 120. Eventually, the shear pins 125 of the inner sleeve 120 can break, and the inner sleeve 120 can move open in the tool's housing 110 so flow in the sleeve's bore 112 can pass out the external ports 114.

Figure 11A:
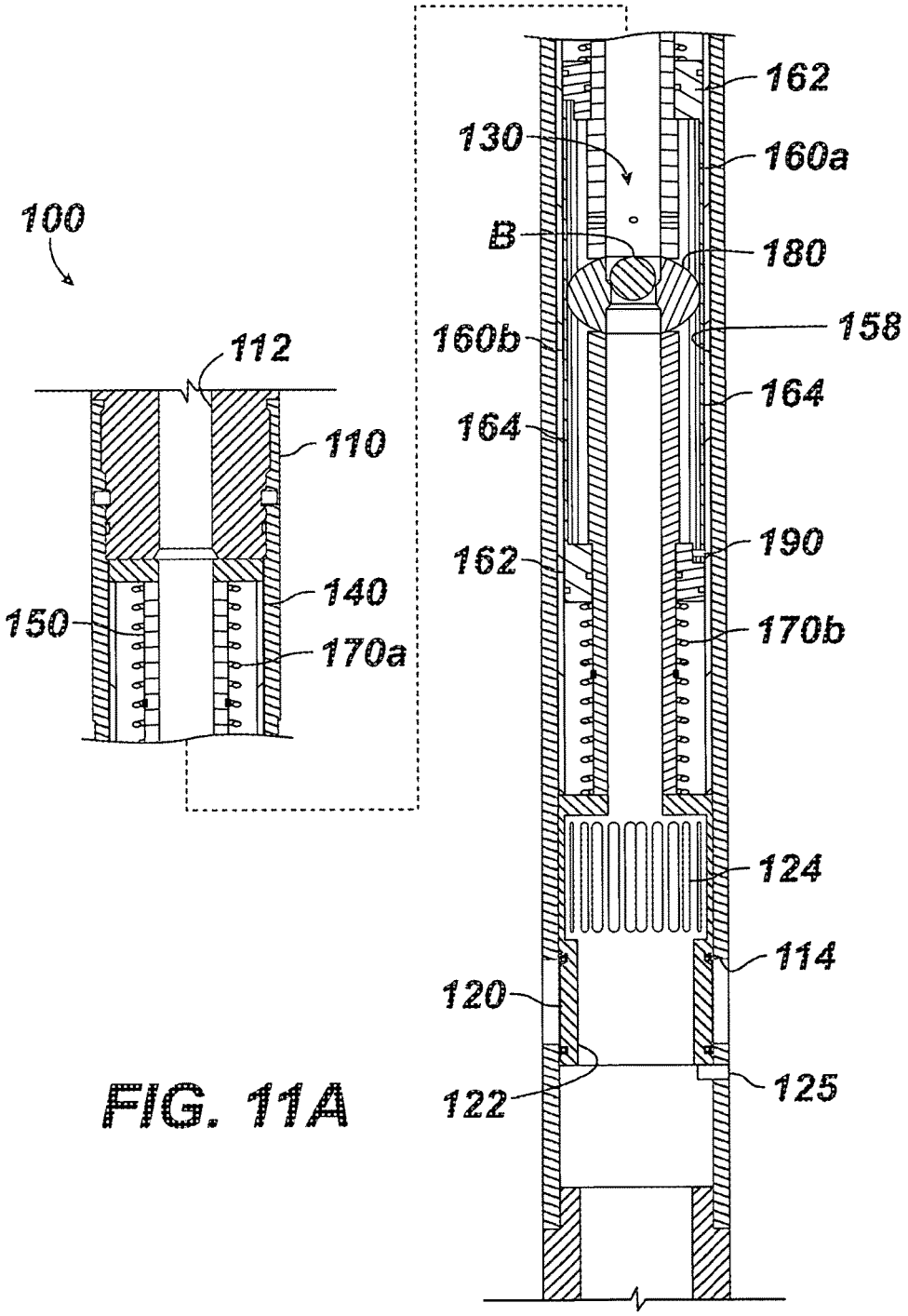
FIGS. 11A-11B illustrate cross-sectional views of another sliding sleeve in closed and opened conditions having a resettable ball seat according to the present disclosure.
Figure 11B:
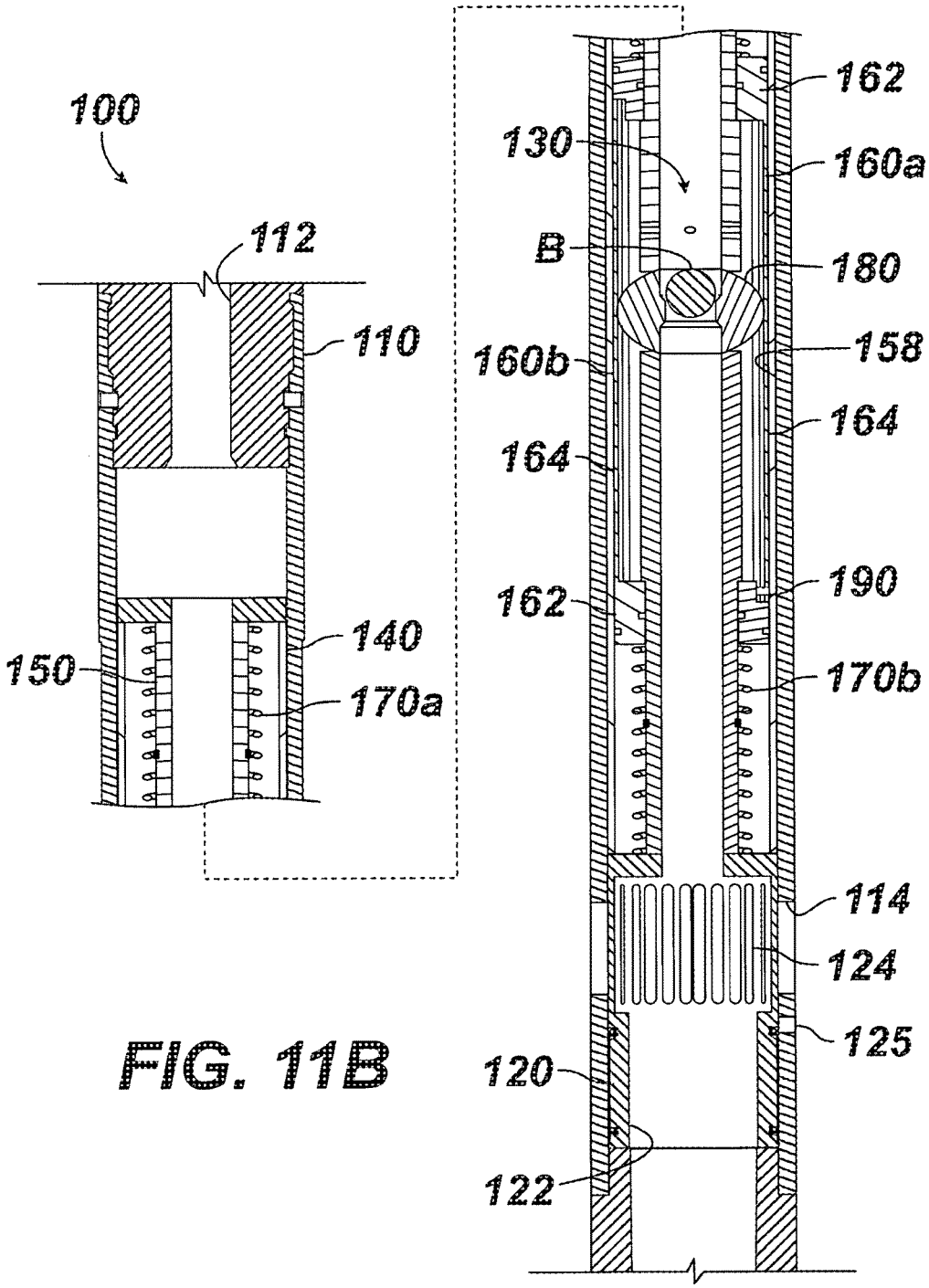

Although the external ports 114 for the sliding sleeve 100 are disposed uphole of the resettable ball seat 180 in FIGS. 9A through 10B, an opposite arrangement can be provided, as shown in FIGS. 11A-11B. Here, the inner sleeve 120 has slots 124 that align with the housing ports 114 disposed downhole from the seat 180 when the inner sleeve 120 is moved downhole in the tool's housing 110. The other components of this configuration can be essentially the same as those described previously.

Figure 12A:
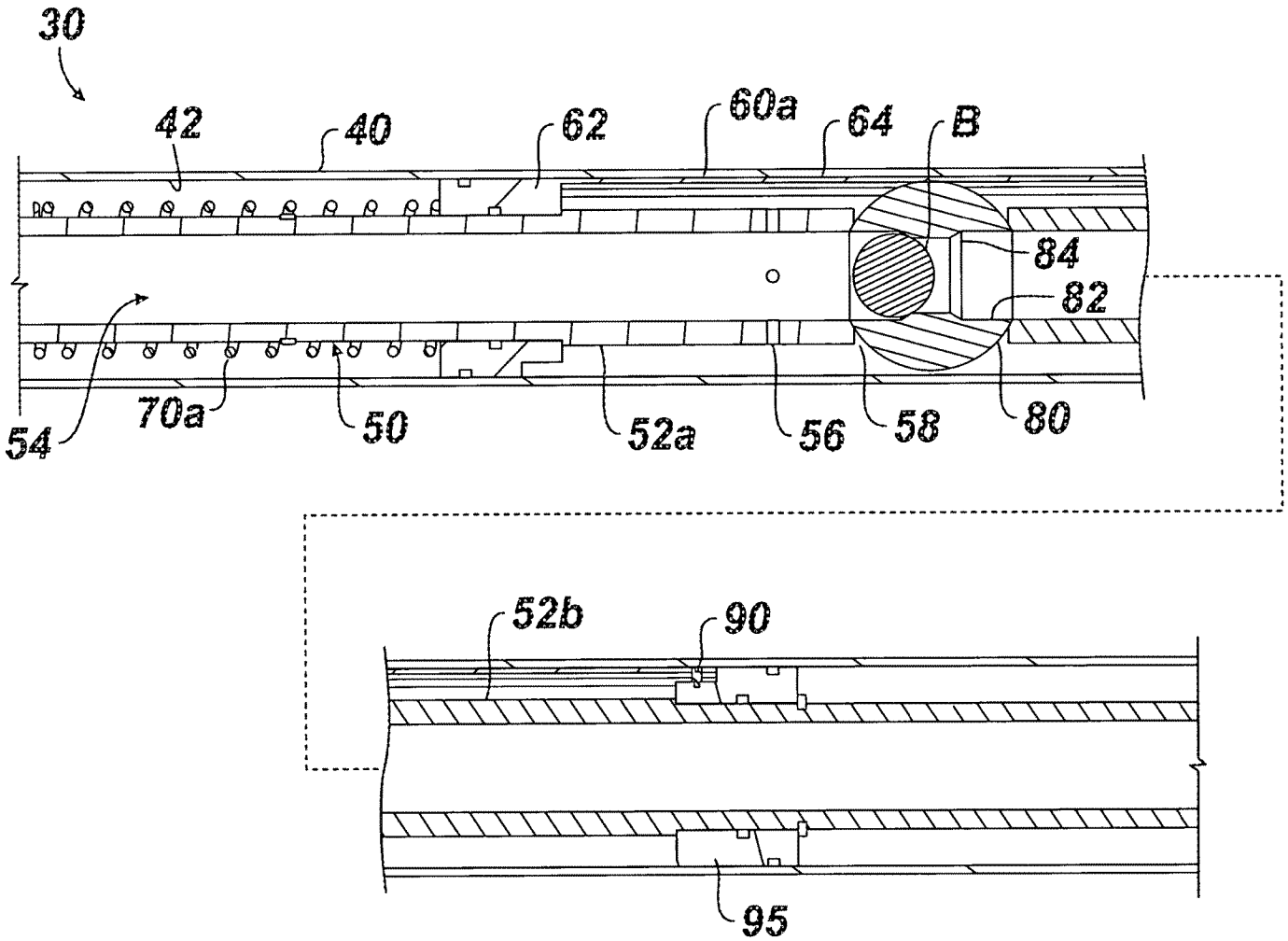
FIGS. 12A-12C illustrate cross-sectional views of another downhole tool having a resettable ball seat according to the present disclosure during opening procedures.
Figure 12B:
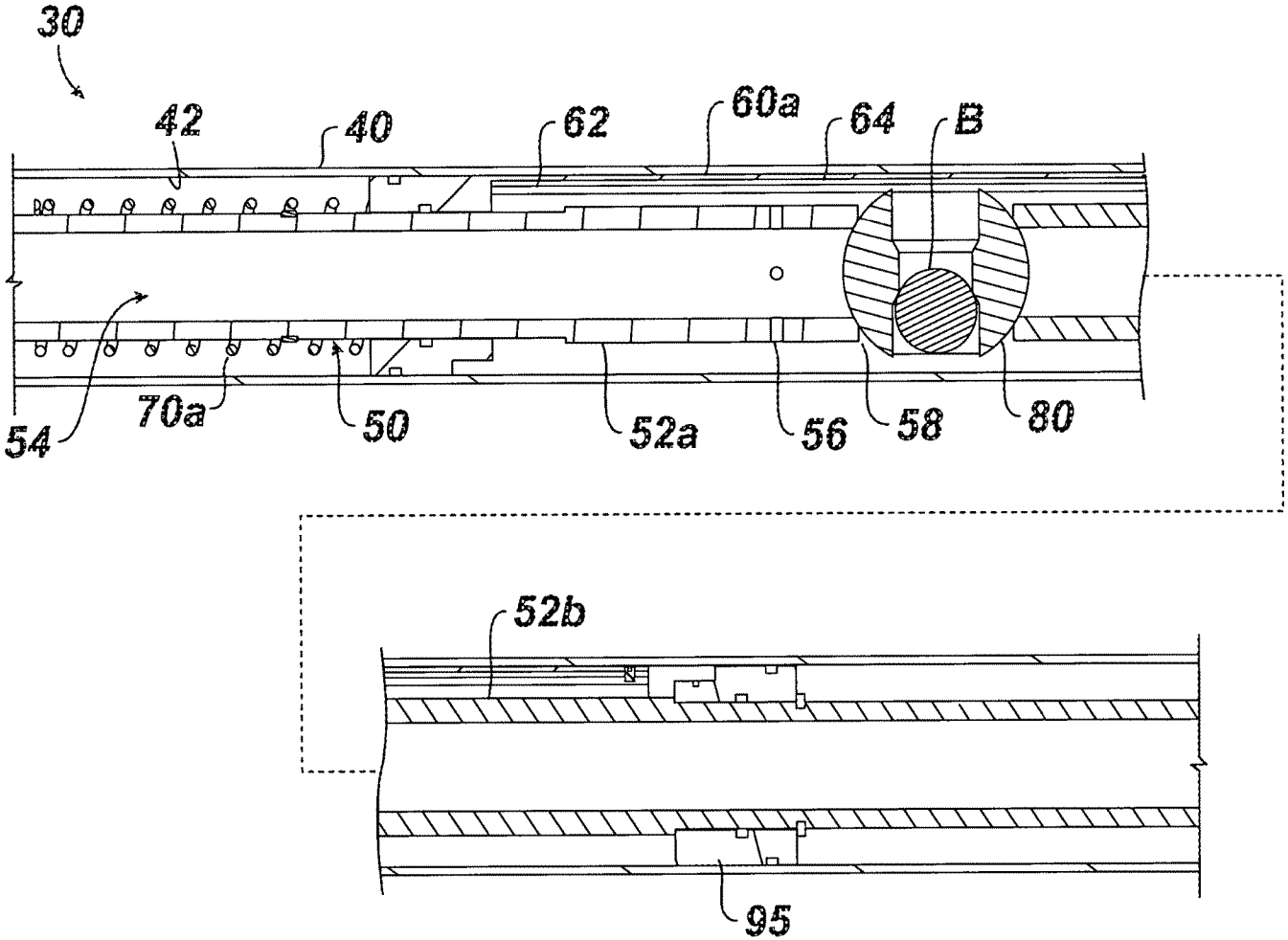
Figure 12C:
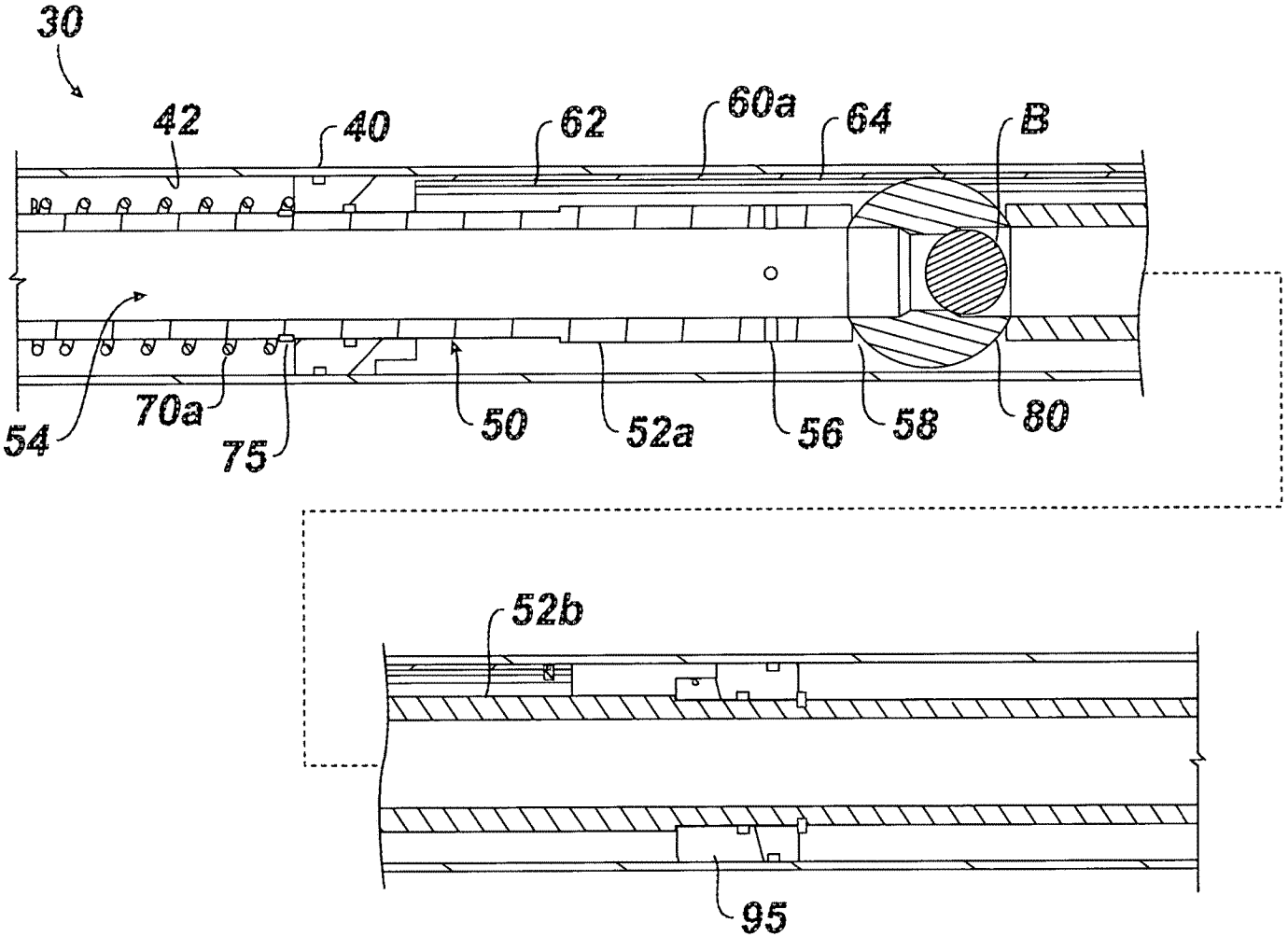

The tools 30/130 have been disclosed above as having a symmetrical arrangement of pistons movable in opposite directions relative to the rotatable ball seat, which rotates but does not move linearly. Although such a balanced arrangement is preferred, an alternative embodiment of the tool can use only one piston in conjunction with the rotatable ball seat. For example, FIGS. 12A-12C show a tool 30 in which like reference numerals refer to similar components of previous embodiments. Rather than having two pistons, the tool 30 has one piston 60*a* movable in the annular space 58 around the upper mandrel section 52*a*. The other end of the annular space 58 has a fixed seal element 95 closing off the annular space 58 around the second mandrel section 52*b*.

When pressure is applied down the bore 54 of the mandrel 50 and enters the annular space 58 through ports 56, the piston 60*a* breaks free and moves linearly in the space 58 against the bias of the spring 70*a*. The sealing element 95 closes off the annular space 58. As the rack gear (not shown) on the piston's stem 64 passes the pinion gear (not shown) on the rotatable ball seat 80, the ball seat 80 rotates in a similar fashion as before as shown in FIGS. 12B-12C. When pressure is released after the piston 60*a* reaches the stop 75, the bias of the spring 70*a* pushes the piston 60*a* back to its initial position, which rotates the ball seat 80 back to its original position to engage the next ball.

The foregoing description of preferred and other embodiments is not intended to limit or restrict the scope or applicability of the inventive concepts conceived of by the Applicants. For example, a rack and pinion gear mechanism has been disclosed above for rotating the ball seat with the piston sleeves. Other mechanical mechanism can be used to rotate the ball seat in a 180 degree rotation back and forth about an axis. For example, instead of rack and pinion gears, the pistons and rotating ball seat can use linkages, levers, cams, ratchets, or the like.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool for use with a deployed plug, comprising:

a mandrel defining an inner bore with an inner port, the inner port communicating fluid pressure in the inner bore with an inner space in the tool;

a seat rotatably disposed in the inner bore of the mandrel and defining an interior passage therethrough, the interior passage having a seat profile for engaging the deployed plug; and first and second pistons connected to the seat and disposed in the inner space on opposing sides of the seat, the first and second pistons movable in opposing directions in the inner space of the tool in response to the communicated fluid pressure, the first and second pistons moved in a first of the opposing directions rotating the seat in a first rotation, the first and second pistons moved in a second of the opposing directions rotating the seat in a second rotation.

2. The tool of claim 1, wherein the seat profile engages the deployed plug and holds the fluid pressure in the inner bore adjacent the inner port.

3. The tool of claim 1, further comprising at least one biasing member disposed in the inner space and biasing the at least one of the first and second pistons in the second direction.

4. The tool of claim 1, further comprising first and second biasing members disposed in the inner space and biasing the first and second pistons toward one another.

5. The tool of claim 1, further comprising a connection at least temporarily holding the first and second pistons relative to one another in the tool.

6. The tool of claim 1, wherein the first and second pistons move apart from one another in response to the communicated fluid pressure, and wherein the movement of the first and second pistons apart rotates the seat in the first rotation from a first orientation to a second orientation.

7. The tool of claim 6, wherein the seat in the first orientation engages the deployed plug, and wherein the seat in the second orientation releases the deployed plug in the inner bore of the mandrel beyond the seat.

8. The tool of claim 6, wherein the first and second pistons move toward one another in response to a reduction of the communicated fluid pressure, and wherein the movement of the first and second pistons toward another rotates the seat in the second rotation from the second orientation to the first orientation.

9. The tool of claim 1, wherein the tool defines an outer port communicating outside the tool, and wherein the mandrel is movable in the tool relative to the outer port.

10. The tool of claim 9, further comprising a first connection at least temporarily holding the mandrel in the tool.

11. The tool of claim 10, further comprising a second connection at least temporarily preventing rotation of the seat.

12. The tool of claim 11, wherein the second connection is configured to break at a lower fluid pressure than the first connection.

13. The tool of claim 1, wherein the seat comprises a pinion gear disposed thereon, and wherein at least one of the first and second pistons comprises a rack gear disposed thereon and mating with the pinion gear.

14. The tool of claim 1, wherein the tool comprises a housing defining a housing bore in which the mandrel is disposed, the space being formed from an annular space between an exterior of the mandrel and the housing bore of the housing.

15. The tool of claim 14, wherein each of the first and second pistons comprises an inner annular seal engaging the exterior of the mandrel and comprises an outer annular seal engaging the housing bore of the housing.

16. The tool of claim 14, wherein the mandrel comprises:

a first mandrel section having a first distal end disposed adjacent the seat, the first mandrel section defining a first portion of the annular space in which the first piston is disposed; and a second mandrel section having a second distal end disposed adjacent the seat, the second mandrel section defining a second portion of the annular space in which the second piston is disposed.

17. The tool of claim 1, wherein the tool is selected from the group consisting of a hydraulically-actuated tool, a sliding sleeve, a packer, and a liner hanger.

18. A downhole tool actuated with a deployed plug, the tool comprising:

a housing defining a housing bore with a housing port communicating outside the housing;

a sleeve disposed in the housing bore of the housing and movable relative to the housing port, the sleeve defining an inner bore with an inner port communicating with an inner space of the sleeve;

a first connection at least temporarily holding the sleeve in the housing;

a seat rotatably disposed in the inner bore of the sleeve and defining an interior passage with a seat profile;

a second connection at least temporarily preventing rotation of the seat; and at least one piston connected to the seat and movable in the inner space in response to fluid pressure communicated through the inner port, the at least one piston moved in a first direction rotating the seat in a first rotation, the at least one piston moved in a second direction rotating the seat in a second rotation.

19. The tool of claim 18, wherein the seat profile engages the deployed plug and holds the fluid pressure in the inner bore adjacent the inner port.

20. The tool of claim 18, further comprising at least one biasing member disposed in the inner space and biasing the at least one piston in the second direction.

21. The tool of claim 18, wherein the at least one piston comprises first and second pistons disposed in the inner space on opposing sides of the seat, the first and second pistons movable in the inner space in opposing directions and adapted to rotate the seat.

22. The tool of claim 21, wherein the first and second pistons move apart from one another in response to the communicated fluid pressure, the movement apart rotating the seat in the first rotation from a first orientation to a second orientation; and wherein the first and second pistons move toward one another in response to a reduction of the communicated fluid pressure, the movement toward another rotating the seat in the second rotation from the second orientation to the first orientation.

23. The tool of claim 22, wherein the seat in the first orientation engages the deployed plug, and wherein the seat in the second orientation releases the deployed plug in the inner bore of the mandrel beyond the seat.

24. The tool of claim 18, wherein the second connection is configured to break at a lower fluid pressure than the first connection.

25. The tool of claim 18, wherein the seat comprises a pinion gear disposed thereon, and wherein the at least one piston comprises a rack gear disposed thereon and mating with the pinion gear.

26. A method of operating a downhole tool, the method comprising:

deploying a plug to a seat rotatably disposed in an inner bore defined in a mandrel of the tool, the inner bore having an inner port communicating fluid pressure in the inner bore with an inner space in the tool;

engaging the deployed plug in the seat rotated in a first orientation in the inner bore, the seat defining an interior passage therethrough, the interior passage having a seat profile for engaging the deployed plug;

applying fluid pressure in the inner bore against the engaged plug;

communicating the fluid pressure in the inner bore against first and second pistons connected to the seat and disposed in the inner space in the tool on opposing sides of the seat;

moving the first and second pistons in opposing directions with the communicated fluid pressure; and releasing the engaged plug from the seat to further along the inner bore by rotating the seat from the first orientation to a second orientation with the movement of the first and second pistons in the opposing directions.

27. The method of claim 26, further comprising rotating the seat from the second orientation back to the first orientation in response to a reduction of the communicated fluid pressure.

28. The method of claim 27, wherein rotating the seat from the second orientation back to the first orientation comprises biasing at least one of the first and second pistons in the tool.

29. The method of claim 26, wherein applying the fluid pressure in the inner bore against the engaged plug further comprises shifting a sleeve relative to an external flow port in the tool.

30. The method of claim 26, wherein moving the first and second pistons with the communicated fluid pressure comprises moving the first and second pistons apart from one another with the communicated fluid pressure.

31. The method of claim 30, further comprising biasing the first and second pistons toward one another.

32. The method of claim 26, further comprising locking the seat in the first orientation with another deployed plug landed in the seat and at least partially in the inner bore.

33. A method of operating a downhole tool, the method comprising:

deploying a plug to a seat rotatably disposed in an inner bore of a sleeve disposed in a housing bore defined in a housing of the tool, the housing bore having a housing port communicating outside the housing, the sleeve movable relative to the housing port, the sleeve defining an inner bore with an inner port communicating with an inner space of the sleeve, the housing bore having a first connection at least temporarily holding the sleeve in the housing, the seat having a second connection at least temporarily preventing rotation of the seat;

engaging the deployed plug in the seat rotated in a first orientation in the inner bore, the seat defining an interior passage with a seat profile;

applying fluid pressure in the inner bore against the engaged plug;

communicating the fluid pressure in the inner bore against at least one piston in the tool, the at least one piston connected to the seat and movable in the inner space in response to fluid pressure communicated through the inner port;

moving the at least one piston with the communicated fluid pressure; and releasing the engaged plug from the seat to further along the inner bore by rotating the seat from the first orientation to a second orientation with the movement of the at least one piston.

34. The method of claim 33, further comprising rotating the seat from the second orientation back to the first orientation in response to a reduction of the communicated fluid pressure.

35. The method of claim 34, wherein rotating the seat from the second orientation back to the first orientation comprises biasing the at least one piston in the tool.

36. The method of claim 33, wherein applying the fluid pressure in the inner bore against the engaged plug further comprises shifting the sleeve relative to an external flow port in the tool.

37. The method of claim 33, wherein moving the at least one piston with the communicated fluid pressure comprises moving opposing first and second of the at least one piston apart from one another with the communicated fluid pressure.

38. The method of claim 37, further comprising biasing the first and second pistons toward one another.

39. The method of claim 33, further comprising locking the seat in the first orientation with another deployed plug landed in the seat and at least partially in the inner bore.

40. The method of claim 33, wherein applying the fluid pressure in the inner bore against the engaged plug comprises breaking the second connection at a lower fluid pressure than the first connection.

* * * * *